United States Patent [19]

Horie et al.

[11] Patent Number: 4,555,250

[45] Date of Patent: Nov. 26, 1985

[54] GRINDING SHEET AND PROCESS FOR PREPARING SAME

[75] Inventors: Shin'ichi Horie; Yutaka Matsuzaki, both of Chichibu; Fumio Kagawa, Kasukabe, all of Japan

[73] Assignee: Showa Denko Kabushiki Kaisha, Tokyo, Japan

[21] Appl. No.: 614,844

[22] Filed: May 29, 1984

Related U.S. Application Data

[63] Continuation-in-part of Ser. No. 442,030, Nov. 16, 1982.

[30] Foreign Application Priority Data

Nov. 16, 1981 [JP] Japan ..... 56-182347

[51] Int. Cl.[4] ..... B24D 3/02

[52] U.S. Cl. ..... 51/309; 51/283 R

[58] Field of Search ..... 51/283 R, 309

[56] References Cited

U.S. PATENT DOCUMENTS 4,010,583 3/1977 Highberg ..... 51/309

*Primary Examiner*—Paul Lieberman

*Assistant Examiner*—Willie J. Thompson

*Attorney, Agent, or Firm*—McAulay, Fields, Fisher, Goldstein & Nissen

[57] ABSTRACT

A glass-grinding sheet is prepared by a process wherein 100 wt. parts of a powdery metal composition consisting of, based on the weight of the composition, 80–96.8% copper, 3–15% of tin and/or zinc, and 0.2–5% of nickel and/or titanium, are mixed with 0.5–30 wt. parts of a diamond powder; the mixture is sintered; and then, the obtained sintered body is rolled into a sheet of the desired thickness. The powdery metal composition is either a copper alloy consisting of (a) copper, (b) tin and/or zinc and (c) nickel and/or titanium, or a mixture of a copper alloy consisting of (a) copper and (b) tin and/or zinc, with (c) nickel and/or titanium.

22 Claims, 7 Drawing Figures

GRINDING SHEET AND PROCESS FOR PREPARING SAME

This application is a continuation-in-part of U.S. Pat. Application Ser. No. 442,030 filed Nov. 16, 1982 in the name of Shin'ichi Horie et al, and assigned to the Assignee of this application.

BACKGROUND OF THE INVENTION (1) Field of the Invention

This invention relates to a grinding sheet for grinding glass lenses such as optical lenses, especially suitable for precise grinding to be conducted after rough grinding, and a process for the preparation thereof.

(2) Description of the Prior Art

A typical process for the production of optical lenses comprises the step of roughing a pressed glass material by using a machine called "curve generator" provided with a cut-type diamond grinding wheel, the sand-grinding step of wet-lapping the roughly ground material with an abrasive (abrasive sand) having a grain size fo about 10 μm and the polishing step (i.e., mirror polishing step) using a polishing powder of cerium oxide and a polishing pad of a foamed polyurethane sheet or a felt. In principle, these three steps are similarly adopted for the production of spherical spectacle lenses and astigmatic spectacle lenses and other lenses such as camera lenses.

At the sand-grinding step, a diamond pellet has recently been used instead of the abrasive sand for increasing the operation efficiency, improving the working environment and simplifying the disposal of the sludge of the abrasive. Since this step does not use an abrasive sand, the step is called "precision grinding step" or "smoothing step". The diamond pellet is a common name for a diamond tool in the form of a tablet which is formed by mixing a metal powder with a diamond powder, compression-molding the mixture and then sintering the molded mixture and is ordinarily used in the form having a diameter of 10 to 20 mm and a thickness of about 3 mm. When this diamond pellet is employed, since the hardness of diamond is higher than that of an fused alumina abrasive customarily used at the sand-grinding step, even if the tool is rotated at a high speed, scattering of the abrasive as observed at the conventional sand-grinding step is not caused, and the grinding efficiency is increased. Furthermore, at the conventional sand-grinding step, since the curvature of a cast iron dish wheel changes in a short time due to wearing, it is necessary to often correct the surface. In contrast, in a dish wheel to which diamond pellets have been bonded, since the degree of wearing is low, the frequency of correction of the surface is reduced. Furthermore, in case of the production of spherical lenses, if optimum conditions for uniform wearing can empirically be found out by adjusting the size of the dish wheel, the manner of bonding the diamond pellets and the position of a so-called spindle for forcing a lens against the dish wheel, the grinding operation can be continued for a long period of time without correcting the surface even if wearing of the diamond pellets is caused. Moreover, in case of the diamond pellets, there is no need of disposal of a sludge.

As is seen from the foregoing description, the grinding operation using a diamond pellet is advantageous over the conventional sand-grinding operation, but the grinding operation using a diamond pellet is not suitable for the production of special lenses such as astigmatic spectacle lenses for the reasons described below.

(1) A diamond pellet is compression-molded at the ordinary molding step in course of preparation while predetermined curvatures are given to the upper and lower surfaces, and it is then sintered. However, the precision for these curvatures is not so high as required for astigmatic spectacle lenses. Accordingly, after the diamond pellets have been bonded to a dish wheel, it must be mutually lapped with a standard dish wheel by using an abrasive sand, before the abrasive dish wheel is used for smoothing. Furthermore, since the surface of an astigmatic spectacle lens is complicated, a long period of time is necessary for this mutual lapping operation.

(2) The processing for formation of the surface of an astigmatic spectacle lens is different from the rotary operation for formation of a spherical spectacle lens and it is difficult or even impossible to find optimum conditions for uniform wearing by adjusting the size of the dish wheel or the position of a spindle and the surface precision changes as the processing operation is continued. In case of a diamond pellet which has a certain thickness, correction of the surface should inevitably be performed before the diamond pellet has been worn away, and therefore, continuation of the operation is disturbed and there arises a problem concerning the stability of the product. If the diamond pellet is discarded without performing the correction of the surface, since diamond is expensive, the process becomes economically disadvantageous. However, a very thin pellet is prepared by sintering, and therefore, the productivity is reduced.

SUMMARY OF THE INVENTION

It is a primary object of the present invention to provide a grinding sheet which is advantageously used for precision grinding of glass products.

Another object of the present invention is to provide a grinding sheet suitable for precision grinding of special lenses having a complicated surface, such as astigmatic spectacle lenses.

In accordance with the present invention, there is provided a process for the preparation of a glass-grinding sheet which comprises the steps of: mixing 100 parts by weight of a powdery metal composition consisting of, based on the weight of the composition, 80 to 96.8% of copper, 3 to 15% of at least one metal selected from the group consisting of tin and zinc, and 0.2 to 5% of at least one metal selected from the group consisting of nickel and titanium, with 0.5 to 30 parts by weight of a diamond powder; sintering the mixture; and then rolling the obtained sintered body.

At least the copper and the metal selected from, tin and zinc in the powdery metal composition constitutes an alloy. More specifically, the powdery metal composition may be either a copper alloy consisting of (a) copper, (b) tin and/or zinc and (c) nickel and/or titanium, or a mixture of a copper alloy consisting of (a) copper and (b) tin and/or zinc, with (c) nickel and/or titanium.

DETAILED DESCRIPTION OF THE PREFERRED EMBODIMENTS

Figure 1:
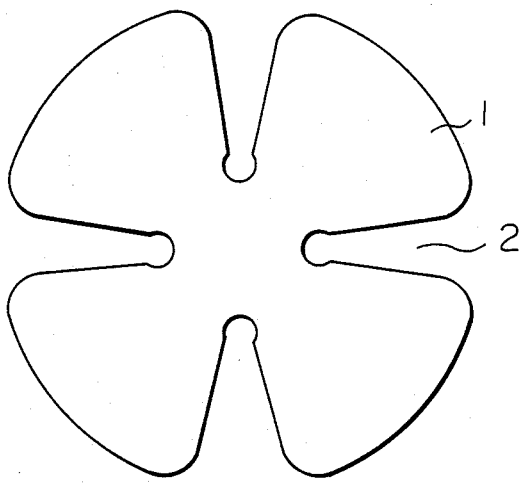
FIG. 1 is a plan view showing one embodiment of the grinding sheet according to the present invention.

The copper alloy that is used in the present invention may be either a single copper alloy or a mixture of two or more of copper alloys.

In order to impart the desired flexibility and abrasive property, it is necessary that the content of copper in the powdery metal composition should be 80% to 96.8% by weight, preferably 85 to 95% by weight, based on the weight of the powdery metal composition. When two or more of copper alloys are used in the form of a mixture, the copper content in the mixture as a whole should be 80% to 96.8% by weight. In order to adjust the hardness of the sintered product, one or both of tin and zinc are contained in the copper alloy and the total amount of tin and zinc is 3% to 15% by weight, preferably 4.5 to 10% by weight, based on the weight of the powdery metal composition. If the content of tin and/or zinc is lower than 3% by weight, the sintered product is too soft and the abrasive property is reduced. In contrast, if the content of tin and/or zinc is too high, the hardness of the sintered product becomes too high and the flexibility is reduced, and when the grinding sheet is used in the state bonded to a dish wheel, no good fitness to the dish wheel can be obtained.

Nickel and/or titanium is contained in the powdery metal composition either as an ingredient of the copper alloy, or as a mixture thereof with a copper alloy consisting of copper and tin and/or zinc. By the incorporation of nickel and/or titanium, the wettability of the binder with the diamond powder is increased and the abrasive property is improved. However, since incorporation of nickel and/or titanium results in increase of the hardness of the copper alloy, it is necessary that the content of nickel and/or titanium should be adjusted while taking the content of tin and/or zinc into consideration and an appropriate content should be selected according to the intended use. The content of nickel and/or titanium is 0.2% to 5% by weight, preferably 0.5% to 5%, based on the weight of the powdery metal composition.

A small amount of a powder of a solid lubricant may be incorporated with the above-mentioned powdery metal composition to be sintered. As the solid lubricant, there may be used finely divided powders of graphite, molybdenum disulfide, boron nitride, agalmatolite and mica. The solid lubricant is effective for preventing formation of scratches on glass, and voids or pores are formed by separation of the solid lubricant during the grinding operation and these voids or pores exert a function of improving the abrasive property.

In order to improve the sintering property, it is preferred that the grain size of the powdery metal composition be up to about 180μ, and a diamond powder having a grain size of about 2 to about 180μ is advantageously used.

The powdery metal composition is mixed with the diamond powder at such a mixing ratio that the amount of the diamond powder is 0.5 to 30 parts by weight per 100 parts by weight of the powdery metal composition.

Both the components are intimately mixed, and the mixture is heated to be sintered, preferably in a casting mold under slight compression. It is preferred that the sintering be carried out at a temperature of 650° to 900° C., more preferably 750° to 850° C., for 20 to 60 minutes, especially about 30 minutes. The sintering atmosphere is not particularly critical, but in order to prevent oxidation of the metals and diamond and improve the degree of sintering, it is preferred that the sintering be carried out in reducing atmosphere. Since the sintered body is rolled afterwards, a high pressure is not necessary for the sintering, and the sintering may be carried out under a relatively low load, for example, about 20 to about 50 g/cm$^2$.

Rolling may be carried out at normal temperatures. However, the sintered body may be heated to some extent so as to reduce the porosity. Unidirectional rolling is preferred so as to obtain a uniform sheet.

It is preferred that the rolling conditions be set so that the porosity of the formed sheet be in the range of from 5 to 20%. If a solid lubricant as mentioned above is incorporated, the porosity is increased. Accordingly, the porosity can be adjusted by controlling the amount of the solid lubricant.

In view of the flexibility, it is preferred that the thickness of the rolled sheet be small. When the rolled sheet is used as a grinding sheet for production of a complicated lens such as an astigmatic lens, it is preferred that the thickness be 0.1 to 0.5 mm. If the thickness is too large, the sheet hardly adheres closely to the curved surface of a dish wheel, and the change of the curvature before the wear-away of the sheet exceeds the ordinary critical precision of 0.1 mm for an astigmatic lens and correction of the surface becomes necessary in the midway. However, if the thickness of the sheet is too small, the life of the sheet becomes short. Accordingly, it is ordinarily preferred that the thickness be in the range of from 0.1 to 0.3 mm.

For the production of the sheet, there may be considered a process in which the above-mentioned mixture is compression-molded to a predetermined thickness as in case of a diamond pellet without performing the rolling operation. However, it has been found that according to this process, if the thickness is reduced below 1 mm, the texture or density tends to become uneven, and the porosity is increased and the life of the grinding sheet is shortened. In contrast, if the rolling operation is adopted, the unevenness of the texture or density is eliminated and since pores are crushed by the rolling, the porosity is reduced and the durability is highly improved. To our great surprise, it has been found that no substantial scratches are formed on the rolling roll by the diamond powder and the rolling process can be adopted advantageously.

Ordinarily, an oil or the like adheres to the rolled sheet and the sheet is hardened to some extent. Accordingly, it is preferred that the rolled sheet be annealed. The annealing temperature is preferably 750° to 850° C. and the annealing is preferably carried out for 20 to 60 minutes, especially about 30 minutes.

The rolled sheet is ordinarily processed according to the shape of the abrasive dish wheel. This processing may be carried out either before or after above-mentioned annealing treatment. Most of abrasive saucers have a circular shape, but some of them have a square shape in which the corners are rounded. In order to process the sheet in comformity with the shape of the abrasive dish wheel, it is preferred that the as-rolled sheet be conformed to the shape of the abrasive dish wheel, because there is no waste in the processing. However, the sheet may be processed to any desirable shape by cutting or the like.

Preferred examples of the shape of the sheet will now be described with reference to the accompanying drawings.

The sheet shown in FIG. 1 has four notches 2 extending from the periphery of the sheet 1 toward the center thereof. It is preferred that at least three notches be formed. If the number of the notches is noe or two, when the sheet is bonded to an abrasive dish wheel with a certain curvature, formation of wrinkles cannot be prevented. If the number of the notches is too large, there arises a risk of breakage when the sheet is bonded to the abrasive dish wheel. At least three notches, optimally 4 to 6 notches, are formed at substantially equal intervals.

It is preferred that the above-mentioned annealing treatment be carried out after formation of the sheet shown in FIG. 1. In this case, by annealing treatment, a good flexibility is imparted to the sheet, and furthermore, burrs formed by the notching operation are removed by annealing and the step of removing burrs can be omitted.

Figure 2A:
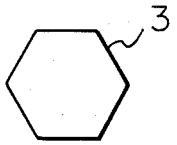
FIG. 2A is a plan view showing another embodiment of the grinding sheet according to the present invention.

The grinding sheet shown in FIG. 2A is an equilateral hexagonal sheet 3 formed from the rolled sheet by punching or the like. The reason why an equilateral hexagonal shape is preferred is that no waste is formed at the punching step and when the sheet is used as a grinding tool, bad influences by the corners of the formed body are moderated. If it is intended only to prevent formation of wastes at the punching step, the sheet may have a square shape. However, in this case, bad influences are caused by the corners of the sheet.

Figure 2B:
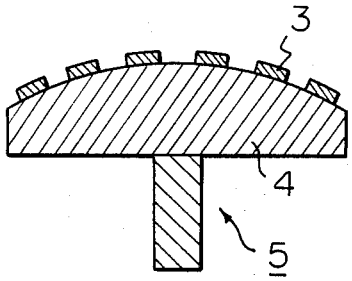
FIG. 2B is a sectional view showing a grinding tool to which a plurality of grinding sheets shown in FIG. 2A are attached.

FIG. 2B shows a grinding tool 5 formed by bonding a plurality of sheets 3 shown in FIG. 2A to an abrasive saucer 4.

Figure 3A:
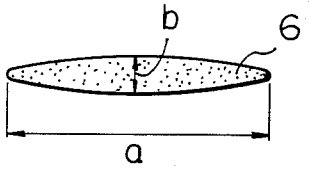
FIG. 3A is a plan view showing another embodiment of the grinding sheet according to the present invention.
Figure 3B:
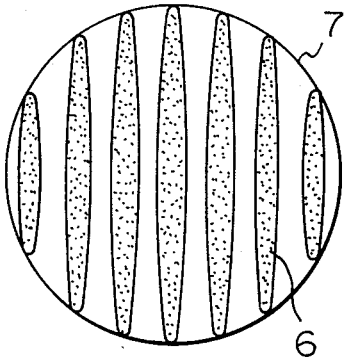
FIG. 3B is a plan view showing a grinding tool to which grinding sheets shown in FIG. 3A are attached.

The grinding sheet 6 shown in FIG. 3A has a long ellipsoidal shape. It is preferred that the ratio of the major axis length a to the minor axis length b, that is, the ratio of a/b, be in the range of from 5 to 20. FIG. 3B shows the state where long ellipsoidal sheets 6 shown in FIG. 3A are bonded to an abrasive dish wheel 7. It is preferred that the long diameter of the long ellipsoidal sheet 6 is substantially is agreement with the diameter of the abrasive dish wheel 7 at the bonding position. In this case, the bonding operation is facilitated, and since the intervals between the two adjacent sheets in the peripheral portion of the abrasive dish wheel where wearing is small is larger than in the central portion, the entire abrasive dish wheel is substantially uniformly worn away and the utilization efficiency is accordingly increased.

Furthermore, in case of the long ellipsoidal sheet, at the rolling step conducted after the sintering for formation of the sheet, it is sufficient if the rolling is performed in one direction, and the productivity is advantageously improved. When many long ellipsoidal sheets 6 differing in the size are prepared, even if dish wheels of different sizes are used, these sheets can be used efficiently and conveniently. Since the sheet has a long ellipsoidal shape, the sheet-bonded area is increased in the central portion of the abrasive dish wheel where wearing is violent during the grinding operation while the sheet-bonded area in the peripheral portion of the abrasive dish wheel is narrowed. Accordingly, the formed body as a whole can be utilized effectively and the life of the formed body as the grinding tool is prolonged. Moreover, since the sheet has a long ellipsoidal shape, it can fit in any abrasive wheel irrespectively of the curvature thereof.

Figure 4A:
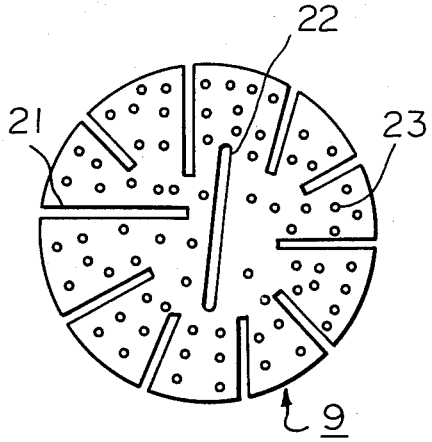
FIG. 4A is a plan view showing still another embodiment of the grinding sheet according to the present invention.

The grinding sheet 9 shown in FIG. 4A has a plurality of small holes 23 and a plurality of notches 21 extended from the peripheral portion of the sheet toward the center thereof.

It is preferred that the diameter of the small holes 23 be about 1 to about 5 mm and the total area of the small holes 23 be about 10 to about 40% based on the total area of the sheet (exclusive of the area of the notches 21). Ordinarily, the notches 21 have a shape extended from the peripheral portion of the sheet toward the center thereof. However, the shape is not limited to a linear shape as shown in FIG. 4A, but a curved shape may be adopted. The number of the notches is determined so that the sheet adheres closely to the adrasive dish wheel, while taking the size and curvature of the abrasive dish wheel into consideration.

In the sheet shown in FIG. 4A, a notch 22 passing through the center of the sheet is formed, and this notch is especially effective when the length of the notches extended from the peripheral portion of the sheet is short or the curvature of the abrasive saucer is large.

Figure 4B:
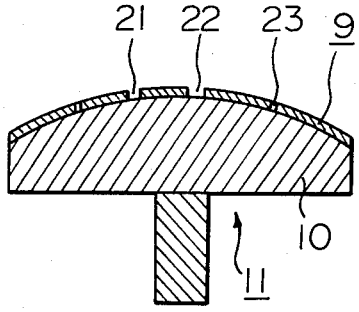
FIG. 4B is a sectional view showing a grinding tool to which grinding sheets shown in FIG. 4A are attached.

FIG. 4B shows a grinding wheel 11 formed by bonding the grinding sheet 9 shown in FIG. 4A to an abrasive dish wheel 10.

Incidentally, in the embodiments shown in FIGS. 2B and 4B, abrasive dish wheels having a convex abrasive surface are illustrated. Of course, in the present invention, an abrasive dish wheel having a concave abrasive surface or an abrasive saucer having complicated shape may be used according to the shape of an article to be ground.

Bonding of the grinding sheet to the abrasive dish wheel can easily be accomplished by using an adhesive. Furthermore, a pressure-sensitive adhesive tape or thermosetting resin adhesive tape may be bonded to the sheet in advance.

In an ordinary grinding mechanism, pores of the grinding tool and the composition of the binder take very important roles, and it is said that a grinding body having a uniform and compact phase, such as a rolled body, is not preferred. Contrary to this conventioal concept, when a rolled sheet obtained by mixing a copper alloy powder with a diamond powder and sintering the mixture according to the process of the present invention is used for precision grinding of glass, a very high grinding capacity is attained and wearing of the sheet is reduced, resulting in prolongation of the life of the grinding sheet.

The present invention will now be described in detail with reference to the following Examples that by no means limit the scope of the invention.

EXAMPLE 1

A powder of an alloy consisting of 88% by weight Cu, 9% by weight of Sn and 3% by weight of Ni (having a grain size smaller than 125$\mu$) was mixed with a diamond powder (having a grain size of 8 to 16$\mu$) in substantially equal volumes (weight ratio = 100:22), and the mixture was charged in a casting mold and sintered under conditions of 800±20° C. and 30 g/cm$^2$ to obtain a sintered body having a length of 13 cm, a width of 11 cm and a height of 0.4 mm.

Then, the sintered body was passed through between rolling rolls at normal temperature so that the porosity was reduced to 15%, whereby a rolled sheet having a thickness of 0.2 mm was obtained. The sheet was annealed in a hydrogen atmosphere at 800° C. for 30 minutes and the annealed sheet was punched to obtain an equilateral hexagonal chip having a side of 6 mm.

The chips were bonded to a convex arcuate surface (the radius of curvature was 66 mm) of an abrasive dish wheel by using an adhesive so that the distance between every two adjacent chips as about 6 mm.

By using the so-prepared grinding tool, a convex lens which had been subjected to rough grinding was ground to obtain results described below.

Polishing machine: Oscar type glass polishing machine
Material ground: BK-7, 70 mm×70 mm
Hairpin load: 500 g/cm$^2$
Rotation number of lower wheel: 400 rpm
Coolant: polyethylene glycol type coolant in the form of solution having concentration of 1/20
Chip-bonded area: 50% of the area of lower wheel
Stock removal for 10 minutes: 400 μm
Surface roughness after 10 minutes' grinding: Rmax of 2 μm
Amount (μ) of ground glass/amount (μ) of worn sheet: 50

EXAMPLE 2

A rolled sheet was prepared in the same manner as described in Example 1 except that the amount of Sn was changed 7% by weight and 2% by weight of graphite was added instead. The porosity was about 17%. Glass was ground in the same manner as described in Example 1 to obtain the following results.

Stock removal for 10 minutes: 370 μm
Surface roughness after 10 minutes' grinding: Rmax of 1.5 μm
Amount (μ) of ground glass/amount (μ) of worn sheet: 45

EXAMPLE 3

A powder (having a grain size smaller than 25μ) of an alloy consisting of 92% by weight of Cu, 7% by weight of Sn and 1% by weight of Ni was mixed with a diamond powder (having a grain size of 8 to 16μ in substantially equal volumes (weight ratio=100:28), and the mixture was charged in a mold and treated for 30 minutes under conditions of 25 g/cm$^2$ and 800±20° C. to obtain a sintered body having a length of 13 cm, a width of 11 cm and a thickness of 0.4 cm. Then, the sintered body was rolled at normal temperature to obtain a rolled sheet having a thickness of 0.2 mm.

A pressure-sensitive adhesive transfer tape was applied to one surface of the rolled sheet, and the sheet was punched by pressing to obtain a molded body having an equilateral hexagonal shape having a side of 6 mm.

The so-molded sheets were bonded to a convex surface of an abrasive dish wheel having a radius of curvature of 66 mm so that the distance between every two adjacent sheets was about 6 mm. A concave lens surface was polished by using the so-prepared grinding tool to obtain the following results.

Polishing machine: Oscar type glass polishing machine
Material ground: BK-7
Hairpin load: 500 kg/cm$^2$
Rotation number of lower wheel: 400 rpm
Coolant: polyethylene glycol type coolant in the form of solution having concentration of 1/20
Sheet-bonded area: 50% of the area of lower wheel
Grinding quantity for 10 minutes: 380 μm
Surface roughness after 10 minutes' grinding: Rmax of 2 μm
Amount (μ) of ground glass/amount (μ) of worn sheet: 48

EXAMPLE 4

A powder (having a grain size smaller than 125μ) of an alloy consisting of 88% by weight of Cu, 9% by weight of Sn and 3% by weight of Ni was mixed with a diamond powder (having a grain size of 8 to 16μ) at a volume ratio of about 3:1 (the weight ratio was 100:9). The mixture was charged in a graphite mold and sintered under conditions of 850±20° C. and 30 g/cm$^2$ to obtain a sintered body having a thickness of 0.45 mm.

The sintered body was passed through between rolling rolls so that the porosity was reduced to 15%, whereby a rolled sheet having a thickness of 0.2 mm was obtained.

A sheet as shown in FIG. 4A was prepared from this rolled sheet. The diameter of the sheet was about 9 cm, the diameter of the small holes was 2.5 mm, the distance between two adjacent holes was about 6 mm, and the width of the notches was 2 to 3 mm.

The sheet was bonded to an abrasive dish wheel having a convex surface having a radius of curvature of 66 mm by using an adhesive, and a roughly ground concave lens was polished to obtain the following results.

Polishing machine: Oscar type glass polishing machine
Material ground: BK-7, 60 mm in diameter
Rotation number of lower wheel: 1550 rpm
Coolant: polyethylene glycol type coolant in the form of solution having concentration of 1/20
Grinding quantity for 10 minutes: 650 μm
Surface roughness after 10 minutes' grinding: Rmax of 3.5 μm
Amount (μ) of ground glass/amount (μ) of worn sheet: 47

EXAMPLE 5

A rolled sheet was prepared in the same manner as described in Example 1 except that a powder of an alloy consisting of 89% by weight of Cu, 8% by weight of Zn and 3% by weight of Ni (having a grain size smaller than 149μ) was used in place of the powder of the Cu-Sn-Ni alloy. The porosity as about 15%. Glass was ground in the same manner as described in Example 1 to obtain the following results.

Stock removal for 10 minutes: 385 μm
Surface roughness after 10 inutes' grinding: Rmax of 1.7 μm
Amount (μ) of ground glass/amount (μ) of worn sheet: 45

EXAMPLE 6

A rolled sheet was prepared in the same manner as described in Example 1 except that a mixture of (a) a powder of an alloy consisting of 90% by weight Cu and 10% by weight of Sn was used and (b) 1.5% by weight of a Ti powder (having a grain size smaller than 125μ) was used in place of the Cu-Sn-Ni alloy powder. The porosity was about 15%. Glass was ground in the same manner as described in Example 1 to obtain the following results.

Stock removal for 10 inutes: 400 μm

Surface roughness after 10 minutes' grinding: Rmax of 2.0 μm

Amount (μ) of ground glass/amount (μ) of worn sheet: 40

We claim:

1. In a process for the preparation of a glass-grinding sheet, which comprises the steps of:

mixing 100 parts by weight of a powdery metal composition comprising copper and at least one metal selected from the group consisting of tin and zinc, with 0.5 to 30 parts by weight of a diamond powder;

sintering the mixture; and then rolling the obtained sintered body;

wherein said improvement comprises:

providing said powdery metal composition with a content consisting of, based on the weight of the composition:

80 to 96.8% of copper, 3 to 15% of at least one metal selected from the group consisting of tin and zinc, and 0.2 to 5% of at least one metal selected from the group consisting of nickel and titanium, and at least the copper and said metal selected from tin and zinc in the powdery metal composition constituting an alloy.

2. A process according to claim 1, wherein said powdery metal composition comprises 85 to 95% by weight of copper.

3. A process according to claim 1, wherein said powdery metal composition comprises 4.5 to 10% by weight of at least one metal selected from the group consisting of tin and zinc.

4. A process according to claim 1, wherein said powdery metal composition comprises 0.5 to 5% by weight of at least one metal selected from the group consisting of nickel and titanium.

5. A process according to claim 1, wherein said powdery metal composition is an alloy.

6. A process according to claim 1, wherein said powdery metal composition is a mixture composed of (i) an alloy consisting of copper and at least one metal selected from the group consisting of tin and zinc, and (ii) at least one metal selected from the group consisting of nickel and titanium.

7. A process according to claim 1, wherein the powdery metal composition and the diamond powder are mixed together with 5% by weight, based on the weight of the resulting mixture, of a solid lubricant.

8. A process according to claim 7, wherein the amount of the solid lubricant is 1 to 5% by weight based on the weight of the resulting mixture.

9. A process according to claim 7, wherein the solid lubricant is selected from the group consisting of graphite, molybdenum disulfide, boron nitride, agalmatolite and mica.

10. A process according to claim 1, wherein said powdery metal composition has a grain size of up to about 180 μm and said diamond powder has a grain size of about 2 to about 180 μm.

11. A process according to claim 1, wherein said mixture is sintered at a temperature of from 650° to 900° C. in a reducing atmosphere.

12. A process according to claim 1, wherein said mixture of the powdery metal composition and the diamond powder is sintered under a load of about 20 to about 50 g/cm$^2$.

13. A process according to claim 1, wherein the sintered body is rolled into a sheet having a thickness of from 0.1 to 0.5 mm and a porosity of from 5 to 20%.

14. A process according to claim 13, wherein the obtained sheet is annealed at a temperature of from 750° to 850° C.

15. A process according to claim 14, wherein the obtained sheet is cut into a desired shape before or after annealing.

16. In a glass-grinding sheet which is prepared by a process comprising the steps of:

mixing 100 parts by weight of a powdery metal composition comprising copper and at least one metal selected from the group consisting of tin and zinc, with 0.5 to 30 parts by weight of a diamond powder;

sintering the mixture; and then rolling the obtained sintered body;

wherein said improvement comprises:

providing said powdery metal composition with a content consisting of, based on the weight of the composition:

80 to 96.8% of copper, 3 to 15% of at least one metal selected from the group consisting of tin and zinc, and 0.2 to 5% of at least one metal selected from the group consisting of nickel and titanium, and at least the copper and said metal selected from tin and zinc in the powdery metal composition constituting an alloy.

17. A glass-grinding sheet according to claim 16, wherein said sheet has a thickness of from 0.1 to 0.4 mm and a porosity of from 5 to 20%.

18. A glass-grinding sheet according to claim 16, wherein said sheet has at least three notches extending from the periphery thereof toward the center thereof.

19. A glass-grinding sheet according to claim 18, wherein said sheet further has a plurality of small holes having a diameter of from about 1 to about 5 mm, the total area of said small holes being in the range of from about 10 to about 40% based on the total area of the sheet (exclusive of the area of the notches).

20. A glass-grinding sheet according to claim 19, wherein said sheet further has a notch perforated in the central portion thereof.

21. A glass-grinding sheet according to claim 16, wherein said sheet has an equilateral hexagonal form.

22. A glass-grinding sheet according to claim 16, wherein said sheet has a long ellipsoidal shape wherein the ratio of the major axis length to the minor axis length is in the range from 5 to 20.

* * * * *